US005398593A

United States Patent [19]

Sirkis

[11] Patent Number: 5,398,593

[45] Date of Patent: Mar. 21, 1995

[54] BREECH LOCK, ESPECIALLY FOR HAND FIREARMS

[75] Inventor: Nehemia Sirkis, Los Angeles, Calif.

[73] Assignees: VOERE Kufsteiner Gerätebau-und Handelsgesellschaft m.b.H., Kufstein; PSE Produkt-und Systementwicklungsgesellschaft m.b.H., Ampass, both of Austria

[21] Appl. No.: 151,900

[22] Filed: Nov. 15, 1993

Related U.S. Application Data

[63] Continuation-in-part of Ser. No. 117,130, Sep. 14, 1993, abandoned.

[30] Foreign Application Priority Data

Mar. 14, 1991 [AT] Austria ..... A567/91

[51] Int. Cl.[6] ..... F41A 3/16

[52] U.S. Cl. ..... 89/174; 89/188; 89/26; 42/16

[58] Field of Search ..... 42/19, 16; 89/19, 20.2, 89/20.4, 21, 26, 174, 185, 188

[56] References Cited

U.S. PATENT DOCUMENTS

| | | | |
|---|---|---|---|
| 1,613,205 | 1/1927 | Soncini et al. | 89/174 |
| 2,297,693 | 10/1942 | Dicke | 89/188 |
| 3,738,223 | 6/1973 | Post et al. | 42/16 |
| 3,776,096 | 12/1973 | Donovan | 89/174 |

FOREIGN PATENT DOCUMENTS

| | | | |
|---|---|---|---|
| 90029 | 8/1910 | Germany . | |
| 312399 | 12/1915 | Germany | 89/188 |
| 341176 | 7/1920 | Germany . | |
| 515972 | 4/1929 | Germany . | |
| 2307133 | 8/1973 | Germany . | |
| 317095 | 4/1934 | Italy | 89/188 |
| 2105 | 2/1916 | United Kingdom | 89/174 |

*Primary Examiner*—Stephen M. Johnson
*Attorney, Agent, or Firm*—Wenderoth, Lind & Ponack

[57] ABSTRACT

A bayonet-connector-like breech lock has a breech housing and a breech block with at least two radially projecting locking components. The enlarged region needed to rotate the locking components takes the form of an annular space wherein a locking sleeve is fitted to rotate between an open and a locked end position. The locking sleeve has a widened section for each locking component aligned with a widened part of the breech block bore in the open end position. The annular space is completely filled by the locking sleeve and the pushed-in breech block.

6 Claims, 3 Drawing Sheets

BREECH LOCK, ESPECIALLY FOR HAND FIREARMS

This is a continuation-in-part of application Ser. No. 08/117,130, filed Sep. 14, 1993, and now abandoned.

BACKGROUND OF THE INVENTION

The invention relates to a breech mechanism for particular use in hand firearms and having a breech piston which pushes a cartridge into a cartridge chamber and which has at least two radially projecting bolt elements. The breech mechanism also has a breech casing, which comprises a breech piston bore, a longitudinal groove for each bolt element and an annulus in which the breech piston bore and each of the longitudinal grooves open and which is provided with a rear engageable supporting surface. Further, a breech sleeve of the mechanism has a groove that is in alignment with the longitudinal groove of the breech piston bore in an open feed position for each bolt element, and is rotatably arranged in the annulus between the open feed position and a locked end position.

Such a breech mechanism is shown, for example, in DE-C 515 972. The breech sleeve totally fills the annulus and the cavity of the breech sleeve is filled by the pushed-in breech piston head and its bolt elements. In so doing, the rear face of the breech sleeve overlaps the longitudinally extending grooves of the breech piston bore. Thus, there is no free space and the breech piston bore is sealed better.

U.S. Pat. No. 3,738,223 shows a breech mechanism with a conical breech piston head on which is mounted a deformable element, which carries an extractor for the cartridge case and which is deformed when the cartridge chamber is locked. The increased contact of the deformed regions against the conical surfaces of the annulus and the breech piston head, and against the groove region of the cartridge case improves the breech-side seal of the cartridge chamber.

SUMMARY OF THE INVENTION

If cartridges without casing are expended, a wall given by means of the cartridge is missing, and the breech-side seal of the cartridge chamber presents a special problem which cannot be solved satisfactorily with the known means. Therefore, the invention is based on the problem of designing a breech mechanism of the aforementioned kind in such a manner that, when there is a malfunction, a recoil of the combustion gases is avoided by means of the breech piston bore.

The invention achieves this goal in that an annulus, or annular space, and the breech sleeve have, on the side of the cartridge chamber, conical contact surfaces. Between the contact surfaces there is a conical sealing sleeve, and the breech casing has at least one gas exit opening that opens into the annulus on its circumference. The conical sealing sleeve improves the sealing of the breech piston bore since it overlaps the gap between the bolt elements of the breech piston and the grooves of the breech sleeve. If there is a malfunction, then the sealing sleeve is forced, due to its conicity, by means of the overpressure against the breech sleeve. The combustion gases then flow into the gap that opens between the sealing sleeve and the contact surface of the annulus to the gas exit opening, by way of which the gases are safely drawn off to the outside. Under normal gas pressure, this gap is sealed by means of the locking pressure of the breech piston.

So that the breech sleeve lies in the open end position required to insert the bolts when the breech piston is displaced, a preferred embodiment of the invention provides that the breech casing has a stop element spring-loaded relative to the axis of rotation of the breech sleeve. The circumference of the breech sleeve has a slot defining the open end position. Thus, the breech sleeve cannot rotate unintentionally. The locked position can also be arrested if the circumference of the breech sleeve has a second slot defining the locked end position.

BRIEF DESCRIPTION OF THE DRAWINGS

In the following the invention is explained in detail with reference to the accompanying drawings, without being restricted thereto, and in which.

DETAILED DESCRIPTION OF THE PREFERRED EMBODIMENT

Figure 1:
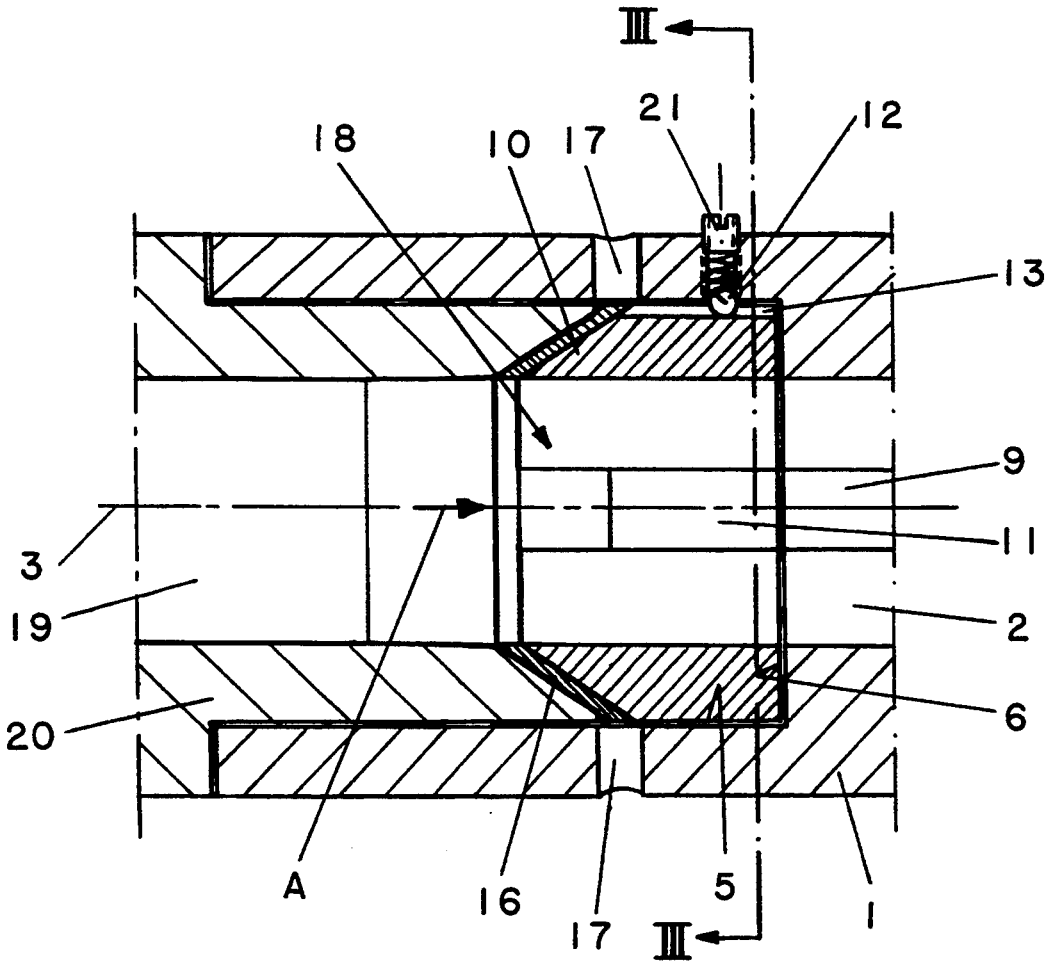
FIG. 1 is a longitudinal view of a breech casing in a locking region of a breech piston.

A breech mechanism forming a bayonet lock comprises a breech casing 1 attached to a barrel 20 and a moveable breech piston 8. The piston 8 is provided with two or three or optionally more bolt elements 4 on the circumference of the piston 8. For each bolt element 4, a breech piston bore 2 is provided with a longitudinally extending groove 9, which opens into an annulus or annular space 5. The breech piston 8, when advanced into a closing position, can be rotated around axis 3, whereby the bolt elements 4 are braced at a face 6 of the annulus 5, so that a front end 22 of the breech piston 8, which rests against a cartridge and which can have a receiving container for a cartridge without casing, is pressed into a cartridge chamber 19 at the end of the barrel 20 and locked there. The annulus 5 tapers in the direction of the cartridge chamber 19 and has a conical contact surface. The conical contact surface is on a member partially defining the annulus 5, i.e. the barrel 20.

Figure 2:
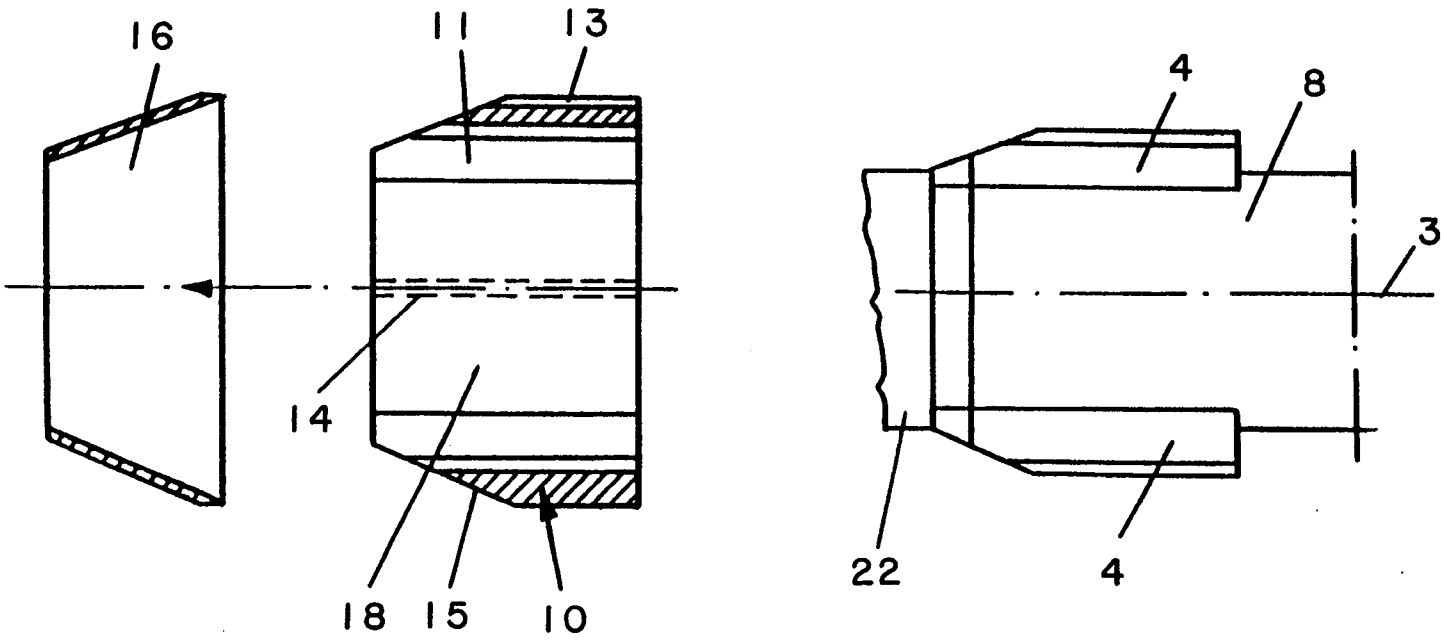
FIG. 2 is an exploded diagram of a bolt region of a breech piston.

A conical sealing sleeve 16 (FIG. 2) and a breech sleeve 10, whose bore 18, which aligns with the breech piston bore 2, has one groove 11 for each bolt element 4, can be rotated in the annulus 5 so that the breech piston 8, advanced into the closing position, totally fills the breech sleeve 10, whereby the bolt elements 4 lie in the grooves 11. The breech sleeve 10 is arrested in two end positions by means of a stop element 12, which is pressed by means of a spring 21 into circumferential slots 13 and 14 by the breech sleeve 10.

Figure 4:
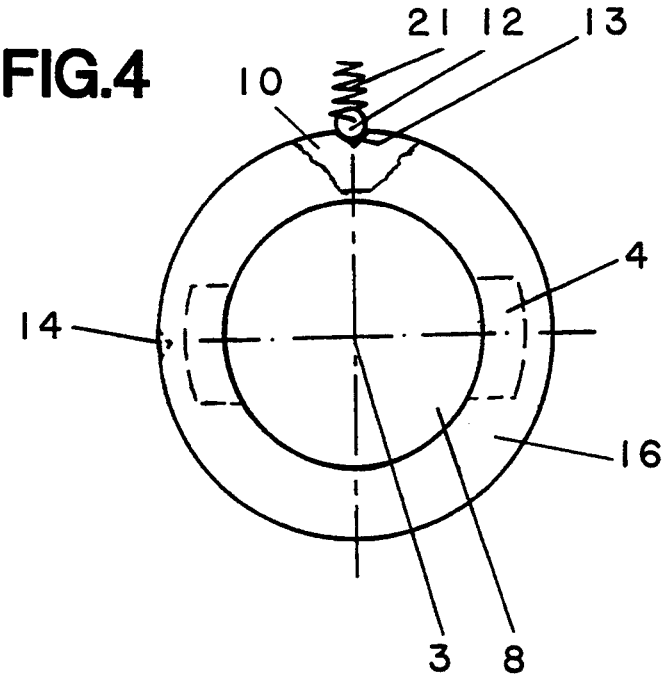
FIG. 4 is a view of an unlocked breech sleeve in the direction of arrow A in FIG. 1.

FIGS. 1 and 4 show the unlocked end position of the breech sleeve 10, in which the longitudinal grooves 9 of the breech piston bore 2 and the grooves 11 of the breech sleeve 10 are aligned with each other. The stop element 12 is pressed into the slot 13.

Figure 3:
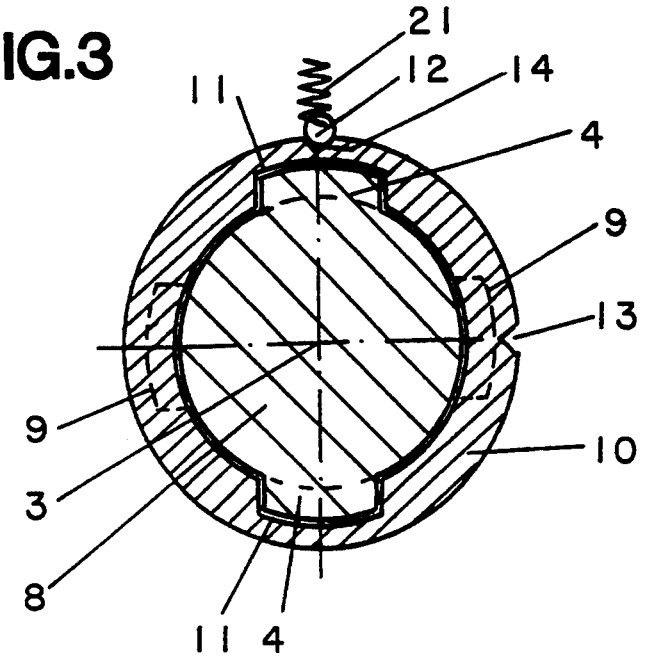
FIG. 3 is a sectional view along line III—III of FIG. 1 with a locked breech piston.

If at this stage the breech piston 8 is locked, the breech sleeve 10 also rotates, whereby the stop element 12 snaps into the second slot 14 (FIG. 3). At the same time, the bolt elements 4 are braced against the face 6 (FIG. 1) of the annulus 5, and the conical contact surface of the breech sleeve 10 is pressed against the conical sealing sleeve 16, which in turn is pressed against the conical contact surface of the annulus 5 so that the cartridge chamber 19 is sealed relative to the breech piston bore 2. As evident from FIGS. 3 and 4, the breech piston 8 fills the breech sleeve 10, which in turn totally fills the annulus 5 and overlaps the longitudinal grooves 9 of the breech piston bore 2 (FIG. 3). The annulus 5 is provided with lateral gas exit openings 17 (FIG. 1), so that in case of a malfunction, the gases cannot escape through the breech piston bore 2, but rather are guided by way of the sealing sleeve 16 to the openings 17, through which they can escape.

I claim:

1. A breech mechanism, comprising:

a breech piston for pushing a cartridge into a cartridge chamber, said breech piston comprising two radially projecting bolt elements;

a breech casing having a breech piston bore extending therein, a longitudinal groove for each of said bolt elements of said breech piston extending along said breech piston bore, and an annular space communicating with said longitudinal grooves and said breech piston bore, said annular space being partially defined by a rear support surface on said breech casing;

a member having an annular space conical contact surface, said annular space conical contact surface further partially defining said annular space;

a breech sleeve rotatably disposed in said annular space of said breech casing so as to be rotatable between an open feed position and a locked end position, said breech sleeve comprising a breech sleeve groove for each of said longitudinal grooves of said breech casing in alignment with said longitudinal grooves in said open feed position and a breech sleeve conical contact surface adjacent to said annular space conical contact surface; and a conical sealing sleeve between said conical contact surfaces of said annular space and said breech sleeve;

wherein said breech casing has at least one gas exit opening therein communicating with said annular space.

2. The breech mechanism of claim 1, wherein said breech casing further comprises a stop element that is spring-loaded against an outer surface of said breech sleeve, and the outer surface of said breech sleeve has a slot therein for receiving said stop element in said open feed position.

3. The breech mechanism of claim 2, wherein the outer surface of said breech sleeve has a second slot therein defining said locked end position.

4. The breech mechanism of claim 1, wherein said gas exit opening communicates with said conical sealing sleeve.

5. The breech sleeve mechanism of claim 4, wherein said gas exit opening extends from an outer surface of said breech casing to said annular space at a position adjacent to said conical sealing sleeve.

6. The breech mechanism of claim 1, wherein said member having said annular space conical contact surface thereon is a barrel connected with said breech casing, said barrel further defining the cartridge chamber.

* * * * *